United States Patent [19]

Watanabe

[11] 4,347,094

[45] Aug. 31, 1982

[54] LABEL APPLYING APPARATUS

[75] Inventor: Shinichiro Watanabe, Tokyo, Japan

[73] Assignees: Sawara Mfg. Works Co., Ltd.; Fukushima Printing Industries Co., Ltd., both of Tokyo, Japan

[21] Appl. No.: 219,308

[22] PCT Filed: Oct. 23, 1979

[86] PCT No.: PCT/JP79/00268

§ 371 Date: Dec. 5, 1980

§ 102(e) Date: Aug. 13, 1980

[87] PCT Pub. No.: WO80/02131

PCT Pub. Date: Oct. 16, 1980

[30] Foreign Application Priority Data

Apr. 5, 1979 [JP] Japan ..... 54-41413
May 4, 1979 [JP] Japan ..... 54-54303

[51] Int. Cl.[3] ..... B65C 9/18; B65C 9/46

[52] U.S. Cl. ..... 156/387; 29/399; 156/238; 156/541; 156/542; 156/568; 156/584; 156/DIG. 33; 156/DIG. 47; 156/273.1

[58] Field of Search ..... 156/215, 387, 272, 380, 156/277, 235, 238, 249, 384, 541, 542, 568, DIG. 33, DIG. 47, 584; 29/399

[56] References Cited

U.S. PATENT DOCUMENTS

| | | | |
|---|---|---|---|
| 1,146,311 | 7/1915 | Davies | 156/387 |
| 2,764,408 | 9/1956 | Weiler | 156/568 |
| 3,351,340 | 11/1967 | Levine | 271/51 |
| 3,508,993 | 4/1970 | Belcher et al. | 156/380 |
| 3,530,028 | 9/1970 | Messmer | 156/584 |
| 3,938,698 | 2/1976 | McDavid, Jr. et al. | 156/568 |
| 4,123,310 | 10/1978 | Varon et al. | 156/568 |

FOREIGN PATENT DOCUMENTS

| | | |
|---|---|---|
| 2063483 | 7/1972 | Fed. Rep. of Germany . |
| 38-26117 | 12/1963 | Japan . |
| 51-26815 | 8/1976 | Japan . |
| 766836 | 1/1957 | United Kingdom . |

*Primary Examiner*—Michael G. Wityshyn
*Attorney, Agent, or Firm*—Edward F. Levy

[57] ABSTRACT

Labels are separated from a strip and charged with static electricity upon separation. The labels are supplied to articles by utilizing static electricity and label adhesion while the adhesive layer surface of the label is directed outwardly. By application of the labels to the articles, the indications printed on the adhesive layer surface of the label or the surface of the articles to be labelled are protected by the label. Thus the layer of printing is prevented from stain and fabrication and indelibility thereof may be obtained.

11 Claims, 8 Drawing Figures

LABEL APPLYING APPARATUS

TECHNICAL FIELD

This invention relates generally to a label applying apparatus, and more particularly to a label applying apparatus of the type capable of printing adhered sides of labels or objects with a lot number, an effective date and a production data and further, interposing a layer to be printed between the label and the object.

Background Art

A dry printer (hot stamp) has been heretofore used to apply a lot number, production date, etc, to articles. This machine is arranged to transfer gold leaf to the articles by heat and thus incorporates inherent deficiencies in that the printing speed is reduced to less than half as compared with a situation where the articles are printed in ink and further, the characters, letters, etc., do not reproduce well due to lack of moisture. In the prior art printing, the labels or the object itself are printed so that indicia such as a lot number and/or production date thereon may be delible. They are thus susceptible to alteration. However, especially for pharmaceuticals, manufacturers are required to print such indications so as to render them indelible or unalterable.

Therefore, an improved labelling process and apparatus has long been desired.

It is, therefore, the primary object of the present invention to provide a label applying method and apparatus by which the articles are printed with better results without decreasing the applying speed and which prevents indicia on labels from being altered.

Another object of the invention is to provide a label applying apparatus which affords higher reliability of label separation from a strip and application of the labels to the articles.

Disclosure of Invention

According to the present invention, a plurality of labels which temporarily and independently adhere to a strip on an elongated carrier means are successively peeled from the strip.

In this separation, the labels are charged with static electricity. This static electricity contributes to the turning over and separation of the labels when fed to the next station such as the label applying means with adhered surfaces thereof directed outwardly. Further, in accordance with the present invention, the labels are applied to the objects to be labelled or the articles in such a manner that a layer to be printed may be interposed between the adhered surfaces of the labels and the articles so that printed characters, letters and patterns or the like on the labels are distinctly maintained to make alteration of such indications impossible.

BEST MODE FOR CARRYING OUT THE INVENTION

The above and other objects of the present invention will become apparent from a reading the following description, taken in conjunction with the accompanying drawings, wherein like numerals are used to designate like parts.

Numeral 1 designates a supply roll for supplying labels 5 which are adapted to be peeled off from a strip 3 such as a plastic sheet of polyester and the like in a path from the supply roll 1 to a take-up roll 6 for winding the strip thereon.

Figure 1:
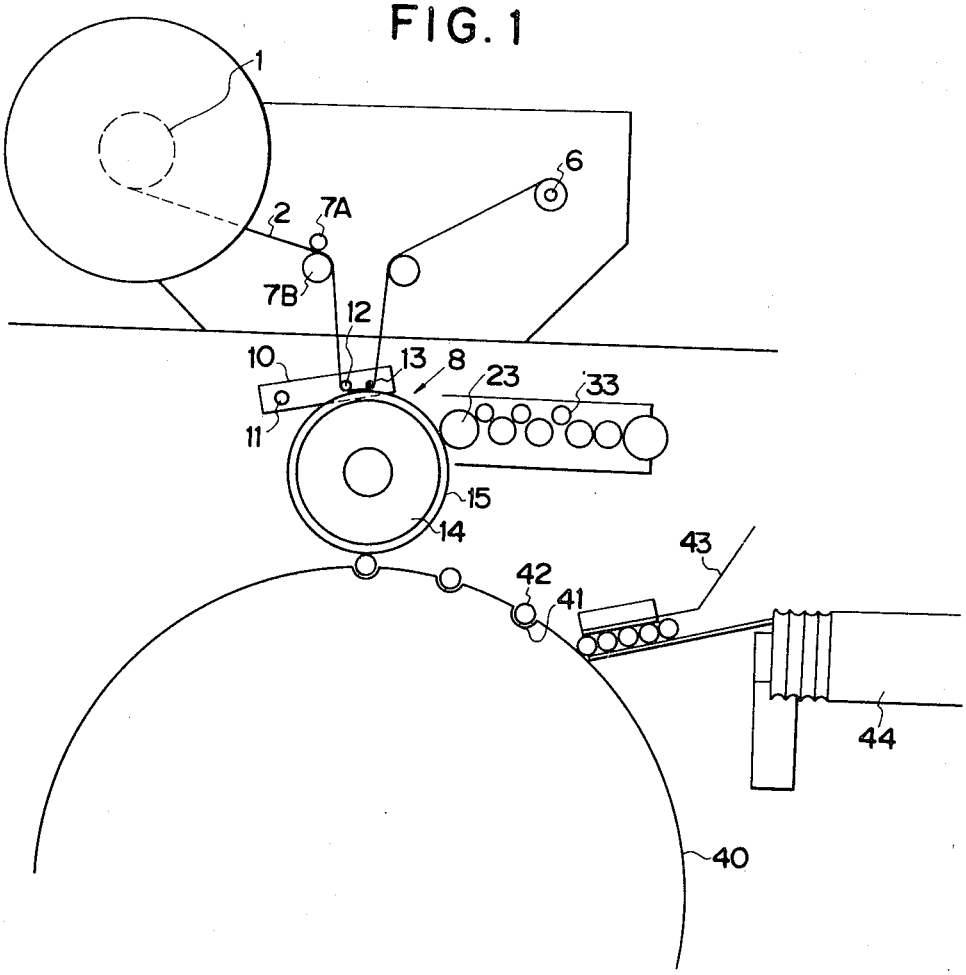
FIG. 1 is a general schematic representation illustrating an overall arrangement of an embodiment of the present invention.
Figure 2:
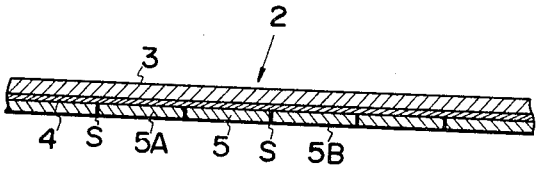
FIG. 2 is a sectional view of elongated carrier means used in the embodiment of the present invention.
Figure 3:
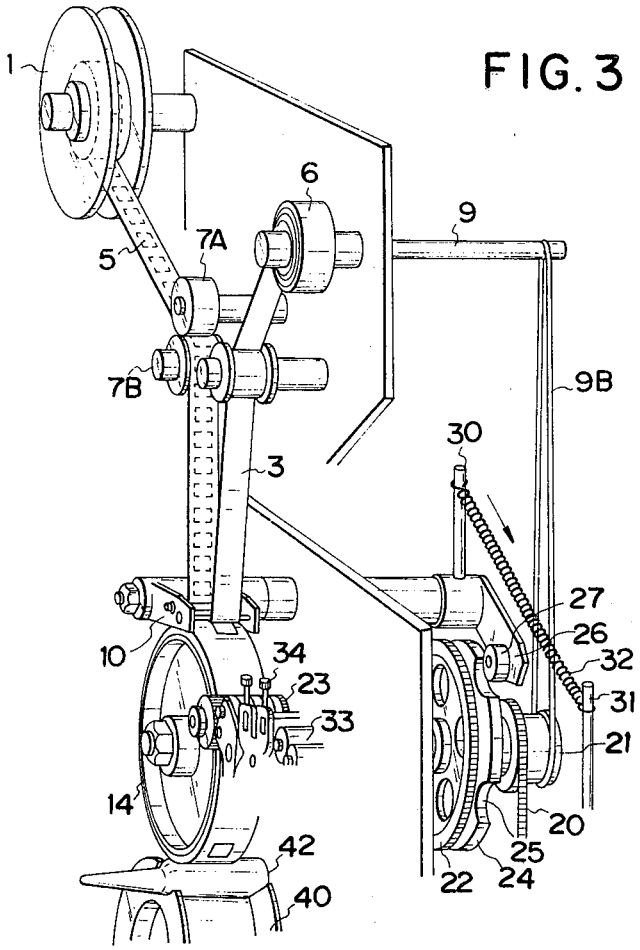
FIG. 3 is a perspective view illustrating the essential parts of the present invention.

Numeral 9 is a rotary shaft for the take-up roll 6 to which rotation is imparted by a drive shaft 21 as will be described hereinafter via a rubber belt 9B (FIG. 3). It is noted that during operation of brake rolls 7A, 7B elongated carrier means 2 is not wound on the take-up roll 6 due to slippage of the rubber belt 9B on the rotary shaft 9. In a preferred embodiment, each of the labels 5 is made of a transparent plastic polyester sheet and the like and is temporarily attached by the adhesive layer 4 of acrylic emulsion type to the strip 3. It is sufficient to disconnect a series of labels 5 by cut-off lines S, but, however, there is no need to space the labels apart at a distance. Elongated carrier means 2 is supplied by the brake rolls 7A, 7B to a separation station 8. These brake rolls 7A, 7B are driven by pressing one against the other. The time for permitting the travel of carrier means 2 is the period between the separation of the labels 5 and the projection of the next labels 5.

Carrier means 2 when led to the separation station 8 is pressed against a silicon rubber surface 15 on separator roll 14 by means of pressure rolls 12, 13 formed on a pressure lever 10 rotatable about a pivot shaft 11, thereby separating the labels 5 from the strip 3 in such a manner as will be described hereinafter, referring to FIG. 3.

Rotation of a drive motor (not shown) is transmitted by a drive belt 20 to a drive shaft 21 of the separator roller 14. Numeral 22 designates a drive gear which is mounted on the drive shaft 21 and serves to further impart rotation to the other component. As schematically shown in the drawing, the drive gear 22 is adapted to impart its rotation to a drive shaft for a printing roller 23, being provided with printing type, at surface speeds four times that of the sepatator roller 14. Reference numeral 24 is a timing cam which is disposed coaxially with the drive gear 22 and includes four arcuate recesses 25 regularly spaced from each other on the periphery of the cam.

A cam lever 26 is secured to the other end of the pivot shaft 11 by which the pressure lever 10 is rotated. The cam lever 26 is formed at its one end with a roller 27 in engagement with the periphery of the timing cam 24. An actuator bar 30 extends upwardly from the cam lever 26 and mounts a spring 32 trained against another bar 31 to apply a clockwise (viewed in FIG. 3) turning effect to the pressure lever 10 and the cam lever 26.

Figure 4:
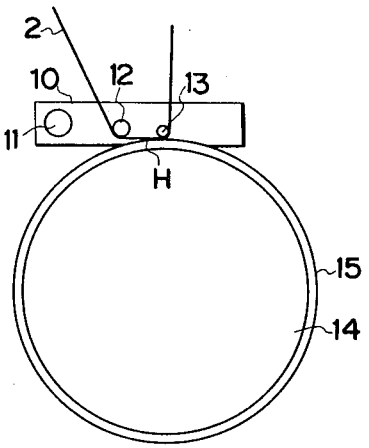
FIGS. 4 and 5 are schematic views illustrating the manner in which a pressure lever is actuated.

When the timing cam 24 is rotated in order to have one of the arcuate recesses 25 face the roller 27, the latter falls into the recess, since the cam lever 26 is clockwise rotated by tensile force of the spring 32. Synchronously therewith, the pressure lever 10 is also clockwise rotated to allow elongated carrier means to abut against the silicon rubber surface 15 coated on the periphery of the separator roller 14. As previously set forth, the elongated carrier means is composed of the labels 5 which adhere by means of the adhesive layer 4 to the strip 3 and are then charged with static electricity by friction caused when the labels are peeled form the strip. The elongated carrier means may be generally charged with static electricity by manually peeling a couple of sheets of the labels until the succeeding labels are peeled by peeling means shown in FIG. 3. The carrier means in roll form may also be charged with static electricity by rubbing it with a plastic bar or plate. By charging the labels in such a manner with static electricity beforehand, the availability of static electricity makes the peeling of the labels easy. Supposing that the labels 5 are ready to be charged with static electricity, the leading labels 5 are positioned to abut against the smoothly processed silicon rubber surface 15 by means of the pressure roll 13. Negative and positive charges are thus induced to the uppermost and inner layers of the rubber surface 15, respectively. Negative electricity is also induced to the lowermost layer of the rubber surface 15 in contact with the separator roller 14 formed of aluminum. Difference in polarity of induced charges serves to apply attracting action to the other component, which action could be one of the important factors in peeling the labels from the strip 3. In order to provide high attracting action derived from static electricity, the surface 15 is preferably made of a material having a higher dielectric constant to increase induced charges. Another factor is adhesion which is applied between the labels 5 and the rubber surface 15 when the label surface is pressed against the rubber surface 15 since the labels are formed of a thinner and flexible polyester sheet or the like. Due to these factors, the labels 5 are successively peeled from the strip in end to end manner and attracted to the rubber surface 15. Then, the direction in which the carrier means travels is sharply turned about a horizontal travel station H defined by the pressure rolls 12, 13 thereby facilitating the separation of the labels 5 in succession (FIG. 4). The one pressure roll 12 is dimensioned to have a diameter greater than that of the other pressure roll 13. This arrangement smooths the running of the carrier means over the horizontal travel station H and allows the carrier means to be fed out at an angle to the station H so that the pressure roller 13 functions as a label separation edge.

Figure 5:
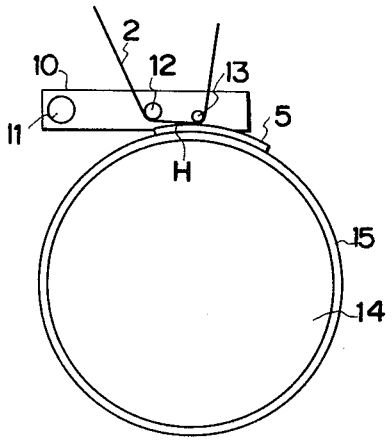

When the roller 27, received in one of the recesses in the timing cam, is gradually rolled out onto the periphery thereof by rotation of the timing cam, at which time about two thirds of the leading label 5 is peeled off, the pressure lever 10 is counterclockwise rotated. As a result, the pressure rolls 12, 13 do not contact the rubber surface 15 to provide a slight gap therebetween (FIG. 5). As two thirds of the leading label 5 has been peeled from the strip and attracted to the rubber surface 15, the label 5 may be completely peeled in its entire section in association with change in the direction of movement of the carrier means over the pressure roll 13. The next label is not peeled as the pressure lever 10 is far away from the rubber surface 15. Due to the presence of the slight gap which is maintained between the rubber surface 15 and the pressure rolls 12, 13 by the horizontal travel station H of the carrier means 2 defined by the pressure rollers 12, 13, the remainder of the label 5 to be separated from the strip 3 may be readily attracted to the rubber surface 15 when not pressured.

The printing roller 23 serves for printing each of the labels on the adhesive layer 4 thus passing over the separator roller. Numerals 33 and 34 designate ink supply rollers and ink regulating screws. The printing roller 23 is rotated at surface speeds four times those of the drive gear 22 and each of the labels 5 is printed in letters subsequently to passage thereof over the attracting position. The printed labels 5 are further rotatably carried on the separator roller 14 and thereafter come in contact with articles such as ampules supplied by an ampule supply roller 40 which ampules are received in axial grooves 41 formed therein. This contact allows the labels 5 to be applied to the periphery of the ampules. Numeral 43 is a dumper for the ampules and numeral 44 is a screw shooter. The articles to be labelled may be, of course, boxed, encased or the like.

Figure 6:
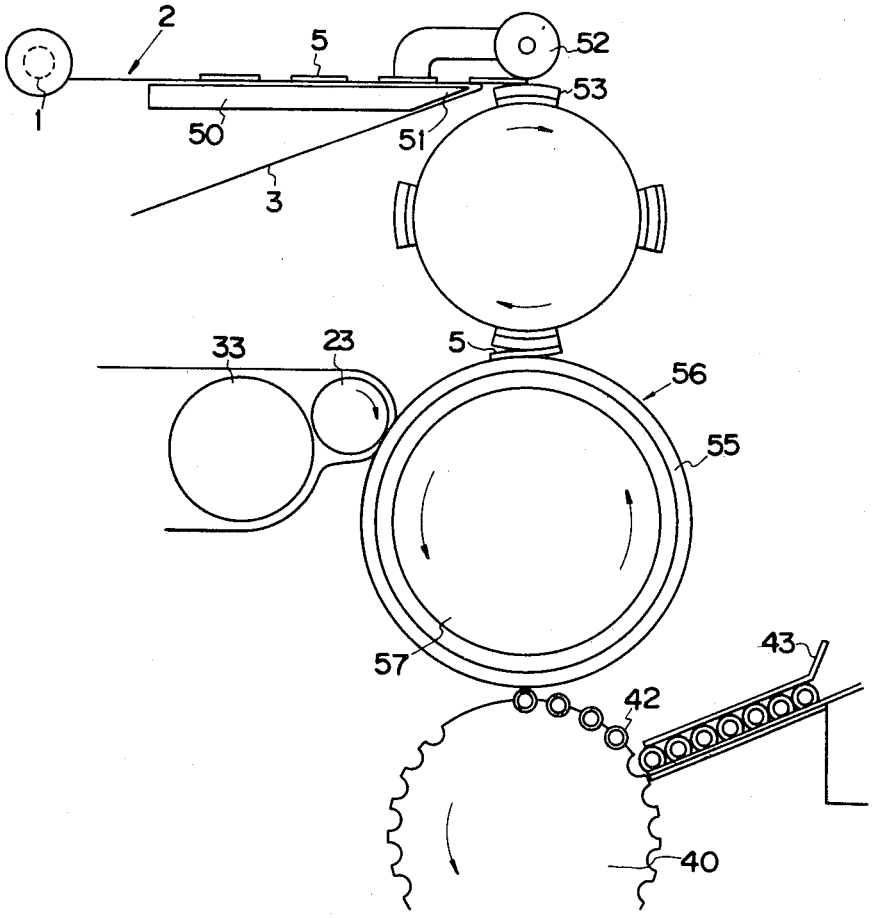
FIG. 6 is a general schematic view illustrating an overall arrangement of an apparatus of another embodiment of the invention.
Figure 7:
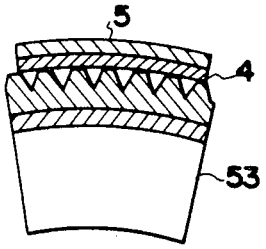
FIG. 7 is a sectional view showing the relation between a separator roller and labels with parts broken away.

Another embodiment of the present invention will hereinafter be explained. As shown in FIG. 6, the elongated carrier means 2, in which the labels 5 releasably adhere to the strip 3 in spaced relation to each other, is advanced to an edge 51 formed at one end of a guide 50. The direction of the elongated carrier means 2 is changed as it passes about said edge, and the tip end of the leading label 5 is moved to be sandwiched between a pressure roller 52 and a separator roller 53. Thus, the leading label 5 is peeled form the strip 3. Thus, the successively separated labels 5 are clockwise rotated as viewed in FIG. 6 by having the adhesive surfaces thereof facing to the separator roller 53 and adhered thereto. As shown in FIG. 7, the separator roller 53 is provided on the periphery thereof with a corrugation formed of rubber or the like. This reduces the area of contact between the separator roller 53 and the adhesive layer surface 4 of the label 5 to which emulsion-type glue is applied.

As previously stated, the labels 5 are charged with static electricity when peeled from the strip 3. Now, the labels 5 are ready to be attracted by static electricity, and the leading label 5 is positioned to abut against a turnover roller 56 the surface of which is smoothly machined and coated with silicon rubber 55. At that time, negative charge is induced to the uppermost and positive charge is induced to the inner layers of the silicon rubber 55. Negative electricity is also induced to the lowermost layer of the rubber 55 in contact with the roller section 57 made of aluminum. Difference in polarity of the induced charges serves to apply attracting action to the other component, whose action is one of the important factors in readily transferring the labels 5 from the separator roller 53 to the turnover roller 56. Another factor is physical adhesion which is applied between the labels 5 and the silicon rubber 55 when the label surface is pressed thereagainst since the labels are formed of a thin and flexible polyester sheet or the like. Under the aforementioned action in a separate or cooperative manner, the turnover roller 56 comes into contact with the separator roller 53 to have the adhesive layer surface 4 of the label 5 on the separator roller 53 directed outwardly after transfer of the label to the turnover roller 56. The labels 5 transferred to the turnover roller 56 as they engage the latter are counterclockwise rotated to abut against an endless belt provided with printing type (not shown), trained about a printing roller thereby printing on the surface of adhesive layer of the labels. The label 5 is made transparent to thus render the indications printed on the glued surface of the label visible. Numeral 33 designates an ink roller for supplying ink to the printing roller 23.

The labels 5 printed by the printing section are further rotated to successively abut against ampules 42 which are supplied to a plane facing the turnover roller 56 with one side (longitudinally of the ampules) in axial grooves 41 formed on the periphery of an ampule supply roller 40 and spaced around the extent thereof. By contact of the label 5 with the ampule 42, the tip end of the label begins to adhere to the ampule 42 in the direction of rotation and simultaneously therewith, the ampules are rotated clockwise thereby applying the label to the ampule. In this instance, the label 5 has been attracted by static electricity to the surface of the turnover roller 56 as above-mentioned, but, however, adhesion of the adhesive layer surface 4 of the label to the surface of the glass ampule is greater than such attracting force to inevitably transfer the label from the turnover roller 56 to the ampule 42. Although the embodiment has been described with reference to printing the adhesive layer surface 4 of the label in application of the label 40 onto the ampule, the object of the invention may be attained by direct printing on the ampules themselves.

Figure 8:
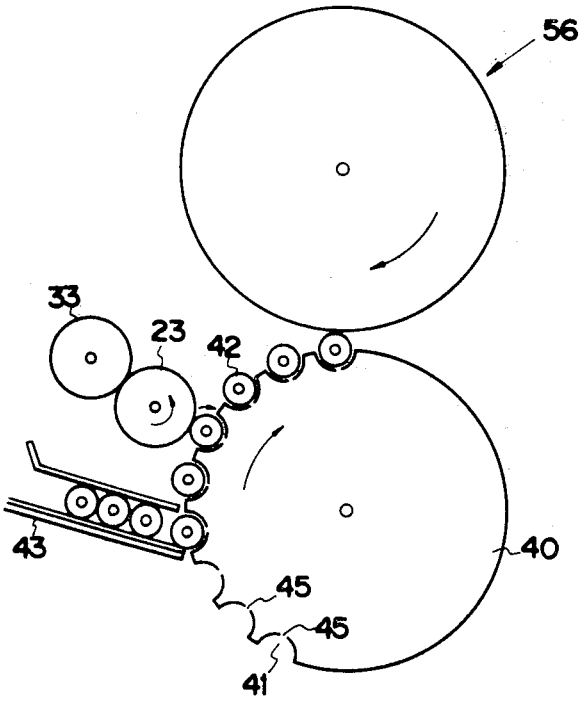
FIG. 8 is a diagrammatic illustration showing a further embodiment of the present invention with parts broken away.

This will be explained with reference to FIG. 8.

The ampule supply roller 40 is adapted to be rotated clockwise in the direction of the arrow. On the other hand, the ampules 42 are successively supplied from the damper 43 to the grooves 41 formed on the periphery of the supply roller 40. Each of the ampules 42 is carried to the printing section with a half side thereof received in each of the grooves. Non-slipping means is preferably provided to prevent the ampules from slipping in the grooves. To this end, for example, slits 45 may be formed in the grooves 41 to introduce negative pressure to attract the ampules to the groove walls by a predetermined pressure.

For printing on the ampules 42 by contact of printing roller 23 therewith, the ampules 42 are rotated in the direction of the arrow by contact friction and then rest to abut against a turnover roller 56 when printing has been completed. As a result, the labels 5 on the turnover roller 56 are applied to cover the printed surfaces of the ampules 42. When it is desired to further rotate the ampules which have already been printed by the printing roller, thereby forcibly applying the labels to the printed surfaces of the ampules 42, a pressure roller (not shown) may be provided between the turnover roller 56 and the printing roller 23 so as to afford rotation upon contact with the ampules and to contact the surface, other than the printed surface of each of the ampules. However, such attention is not required if the width of the label is equal to the peripheral length of the ampule, and a machine for printing on the ampule, which is widely and generally used as an ampule printer, may be applicable.

Industrial Applicability

According to the present invention, the layer to be printed may be interposed between the label and the object to be labelled to allow the label to protect the printed layer. For this reason, onetime printed indicia are distinctly maintained to make alteration and fabrication impossible. The present invention is most suitable for applying the labels to pharmaceuticals which are required to indicate a lot number, a production date and effective date in an indelible and nonforgery manner in accordance with the Drugs, Cosmetics and Medical Instruments Act.

Further, in accordance with the present invention, onetime printed indicia are protected by the lables and are not delible or blurred by friction with other articles or water and the like so that it is suitable for applying the labels to items such as ampules, bottles and flasks for refrigerants.

What is claimed is:

1. Apparatus for applying labels to articles, comprising: elongated carrier means comprising a strip for supporting a plurality of discontinuous labels which are adapted to releasably adhere to said strip by an adhesive on one surface thereof;

supply and take-up rolls for said elongated carrier means;

label turnout and separator means for separating said labels from said strip intermediate of said supply and take-up rolls to charge said labels with static electricity by friction created by peeling said lables from said strip, so that said labels are attracted by said static electricity to an electrically charged roller whose periphery is dielectric, with the adhesive surfaces of said labels turned out, thereby supplying said labels to the next station;

means for applying said labels to said articles; and means disposed between said label turnout and separator means and said label applying means for interposing printed indicia between said adhesive surface of said labels and said articles to be labelled.

2. Apparatus as claimed in claim 1 including a first roller, said label turnout and separator means including means for transferring said labels from said strip to said first roller with the adhesive surfaces of said labels facing said first roller, said charged roller being rotatable by contact with said first roller.

3. Apparatus as claimed in claim 2, wherein the periphery of said first roller is provided with a corrugation.

4. Apparatus as claimed in claim 1, wherein said indicia are printing on the adhered surfaces of said labels.

5. Apparatus as claimed in claim 1, wherein said indicia comprise printing on the surfaces of said articles.

6. Apparatus as claimed in claim 1, wherein said separator and turnout means comprise a pressure lever mounted on a pivot shaft for rapidly changing the direction of travel of said elongated carrier means, said pressure level being rotatable about its pivot shaft and adapted to have one of said labels on said carrier means abut against an elastic dielectric surface of said charged roller before label peeling, said pressure lever being spaced from said dielectric surface at a minimum distance before completion of said peeling, and said charged roller being adapted to supply said labels to said next station with the adhesive surface turned outwardly.

7. Apparatus as claimed in claim 6, wherein said lever includes a first pressure roll on the upstream side of said carrier means, and a second pressure roll on the downstream side of said carrier means.

8. Apparatus as claimed in claim 7, wherein said first pressure roll is of substantially greater diameter than said second roll.

9. Apparatus as claimed in claim 8, wherein said first and second pressure rolls guide said carrier means in a substantially horizontal run adjacent said charged roller.

10. Apparatus as claimed in claim 8, wherein said second pressure roll is of sufficiently lesser diameter than said first pressure roll so that said carrier means is carried from said pressure lever at an angle more acute than that at which said carrier means is received by said pressure lever.

11. Apparatus for applying labels to articles, comprising: elongated carrier means comprising a strip for supporting a plurality of discontinuous labels which are adapted to releasably adhere to said strip by an adhesive on one surface thereof;

supply and take-up rolls for said elongated carrier means;

label turnout and separator means for separating said labels from said strip intermediate of said supply and take-up rolls, said strip being pre-charged with static electricity for charging said labels supported thereon, whereby said labels, upon separation by said label turnout and separator means, are attracted by said static electricity to an electrically charged roller whose periphery is dielectric, with the adhesive surfaces of said labels turned out, thereby supplying said labels to the next station;

means for applying said labels to said articles; and means disposed between said label turnout and separator means and said label applying means for interposing printed indicia between said adhesive surface of said labels and said articles to be labelled.

* * * * *